US007127871B2

(12) United States Patent
Putz et al.

(10) Patent No.: US 7,127,871 B2
(45) Date of Patent: Oct. 31, 2006

(54) SYSTEM FOR PACKAGING A FLEXIBLE WEB THAT IS LAYERED IN ZIGZAG LOOPS, IN PARTICULAR A TEXTILE WEB

(75) Inventors: Matthias Putz, Langenfeld (DE); Bernhard Merckelbach, Remscheid (DE); Andreas Klocker, Wuppertal (DE)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 10/521,303

(22) PCT Filed: Jun. 16, 2003

(86) PCT No.: PCT/CH03/00387

§ 371 (c)(1),
(2), (4) Date: Dec. 22, 2004

(87) PCT Pub. No.: WO2004/002833

PCT Pub. Date: Jan. 8, 2004

(65) Prior Publication Data

US 2005/0235601 A1 Oct. 27, 2005

(30) Foreign Application Priority Data

Jun. 27, 2002 (CH) ..... 1109/02

(51) Int. Cl.
*B65B 63/04* (2006.01)

(52) U.S. Cl. ..... 53/117; 493/415

(58) Field of Classification Search ..... 53/116, 53/117; 270/39.05; 493/415
See application file for complete search history.

(56) References Cited

U.S. PATENT DOCUMENTS

| | | | | |
|---|---|---|---|---|
| 3,707,063 | A | 12/1972 | McIntyre | |
| 3,868,809 | A | 3/1975 | Bledsoe | |
| 3,942,300 | A * | 3/1976 | White | 53/116 |
| 4,493,689 | A * | 1/1985 | Affupper | 493/415 |
| 4,573,958 | A * | 3/1986 | Biesinger | 493/415 |
| 6,305,146 | B1 * | 10/2001 | Gerber | 53/116 |
| 6,321,512 | B1 | 11/2001 | O'Connor et al. | |

FOREIGN PATENT DOCUMENTS

| | | | |
|---|---|---|---|
| DE | 3334111 | A1 * | 3/1985 |
| DE | 3 444 897 | A1 | 6/1986 |
| EP | 0 062 753 | A1 | 10/1982 |
| EP | 0 778 236 | A1 | 6/1997 |
| JP | 59026861 | A * | 2/1984 |

* cited by examiner

*Primary Examiner*—Stephen F. Gerrity
(74) *Attorney, Agent, or Firm*—Klaus P. Stoffel; Wolff & Samson PC

(57) ABSTRACT

The system for packaging a flexible web (2) that is layered in a zigzag loops comprises the following for simplifying the handling and packaging processes: a layering device (1) for forming a tier consisting of a web (2) that is layered in zigzag loops; a transfer device (26) for directly or indirectly transferring the looped web tier to a packaging container; and a memory-programmable control device for components of the system.

20 Claims, 8 Drawing Sheets

SYSTEM FOR PACKAGING A FLEXIBLE WEB THAT IS LAYERED IN ZIGZAG LOOPS, IN PARTICULAR A TEXTILE WEB

PRIORITY CLAIM

This is a U.S. national stage of International Application No. PCT/CH2003/000387, filed on Jun. 16, 2003. Priority is claimed on that application and on the following application:

Country: Switzerland, Application No. 1109/02, Filed: Jun. 27, 2002.

BACKGROUND OF THE INVENTION

1. Technical Field

The invention relates to a system for packaging a flexible web, in particular a textile web, which is positioned in zigzag-form loops, according to the preamble of claim 1.

2. Prior Art

EP 0 062 753 B and EP 0 778 236 A disclose a system of the type mentioned in the introduction in the case of which a flexible web, in particular a textile web, is positioned in zigzag-form loops and an arrangement of web loops is thus formed. The resulting web-loop arrangements are stacked manually and packaged into a packaging container and then processed further in the textile industry. For this purpose, the web-loop arrangements have to be stacked manually in a packing shaft, that is to say they have to be transferred manually into the packaging shaft by operators, and an arrangement of web loops is thus formed, via push-off plates. The operations of determining the number of web loops per arrangement and of separating the web loops in a precise and defined manner between the respectively bottom and top planes are difficult to automate on account of the random positioning of the textile web loops and of the sensitivity of the web-loop arrangements to pressure. Such web-loop arrangements are generally difficult to handle since they are subjected to a high level of internal stressing at the folds and thus tend to deform easily because, at the folds, the web tries to return into the straightened-out position again. The operator thus lines the packing shaft with a paper sheet prior to the first web-loop arrangement being introduced. Once the desired web length has been achieved, in the first instance, the group as a whole has the paper sheet wrapped around it and this paper sheet is fixed with adhesive tape in order that the web-loop arrangements do not come apart. It is only then that the group as a whole can be removed from the packing shaft and deposited in a packaging container.

U.S. Pat. No. 6,321,512 B discloses a system which is intended for packaging a flexible web positioned in zigzag-form loops and in the case of which a vertically fed length of material is cut into individual webs in the first instance, these webs then being positioned together in loops and the web loops being jointly introduced vertically into a container which is fitted over them. No indication is given here of the possibility of using the system to form, on a horizontal bearing panel, a web-loop arrangement of predeterminable magnitude which could then, moreover, be transferred into a packaging container.

DESCRIPTION OF THE INVENTION

The object of the invention is to improve the system mentioned in the introduction.

The object is achieved by a packaging system having a positioning device that is assigned a transfer device which can produce a web-loop arrangement of predeterminable magnitude and which allows the web-loop arrangement produced to be transferred directly or indirectly into a packaging container. A memory-programmable control device controlling components of the system allows at least partial automation of the operating sequences.

A further embodiment of the invention is particularly advantageous, in that the positioning and packaging operation can be carried out fully automatically without any need for an operator. The packing density can be improved by a refinement of the system in which the length of the web loops can be adjusted to a different magnitude from one web-loop to the next at the control device since, then, the region of greatest stressing, which is provided by the folds of the loops, is not restricted to the border region of the web-loop arrangement; rather, adjacent folds may be offset in relation to one another, this achieving a significant dissipation of the stressing at the border and allowing closer packing of the web loops. A significant improvement in the packing is achieved by making it possible to adjust the length of the web for each web-loop arrangement at the control device since the length of the web per pack can be distributed uniformly over the web-loop arrangements and the individual web-loop arrangements thus also each have a uniform density. The web which is packaged in this way thus has constant properties over its entire length, such as uniform stressing throughout the arrangement, which, on the one hand, allows better utilization of the packaging container and, on the other hand, ensures uniform properties of the web, in particular for the subsequent further processing thereof. Elastic webs in particular can shrink together uniformly in the packaging container. The elasticity of the web is thus maintained uniformly over the entire length thereof since residual stressing in certain sections, which could result in material fatigue and a loss in elasticity, is avoided. A high-quality final product is thus made possible, all this with reduced manpower and increased performance.

The web positioned in loops has the tendency to straighten out in the folding region, as a result of which considerable forces occur in the web-loop arrangement, in particular in the folding region of the web loops, and these counteract an ordered web-loop arrangement. An advantageous configuration of the system is thus one according to which the positioning device has, in the positioning region, a pressure-exerting bar which runs over the entire loop length, can be advanced perpendicularly to the bearing panel for the web-loop arrangement, can be pressed against the edges of the web loops and prevents the loops from opening up. The pressure-exerting bar is preferably provided with a controlled drive in order for this pressure-exerting bar to be raised up during transfer of the web-loop arrangement, and thus for the transfer to be facilitated.

A system is particularly expedient, in which case the transfer device has preferably finger-like pusher members on the infeed side of the web in the positioning device, it being possible for these pusher members to be displaced out of a rest position, in which the web feed is not impeded, into an operating position, in which these pusher members can be moved through beneath the pressure-exerting bar, parallel to the bearing panel of the web-loop arrangement, to be precise until, on the other side of the pressure-exerting bar, carry-along elements can be moved in between or behind the web-loop arrangements from a rest position in order to receive the web-loop arrangement and displace it into a receiving device transversely to the loop arrangement. The pusher members can be moved into the operating position from different positions, for example from a rest position beneath, to the side of or behind the bearing panel. A particularly preferred refinement, however, is one in which the pusher members are moved vertically downward into the operating position from a raised rest position above the bearing panel. The same applies to the carry-along elements behind the pressure-exerting bar, it likewise being possible for these carry-along elements to assume a wide variety of different rest positions to the side of and beneath the bearing panel. A particularly preferred refinement here is one in which the carry-along elements are of finger-like design and can be moved in between the pusher members in the vertically downward direction from a top rest position. The web-loop arrangement is thus constantly controlled, either by the pusher members or by the carry-along fingers, throughout the transfer movement.

Also conceivable, however, is a simplified solution in which, rather than the pusher members being moved through beneath the pressure-exerting bar, the web-positioning operation takes place continuously and the web-loop arrangements are transported further downstream of the positioning device by means of blades arranged on a displacement bar. For this purpose, it is possible for the blades, in the first instance butting against one another, to be moved in between two web loops from above and then moved apart from one another laterally in order to separate two web loops and to transfer the web-loop arrangement located in front of them. In the case of this solution, the web-positioning operation need not be interrupted, as a result of which the productivity increases. However, this variant can only be used to process a very small number of straightforward and non-critical webs.

It is advantageous here if the system is designed such that the bearing panel for the web-loop arrangement has braking strips along the displacement path of the folds, from the positioning device into the receiving device. Ordered transfer is also aided by a refinement according to which guide bars which guide the web-loop arrangement and are oriented transversely to the loop arrangement are arranged above the bearing panel. According to another embodiment, at least one resiliently yielding stop member may be arranged in the receiving device, in the region between the folds, in order for web parts which curve forward in the receiving direction to be forced back, that is to say oriented, parallel to the loop arrangement.

A packaging container may already be arranged in the receiving device in order to accommodate the web-loop arrangement. A more advantageous refinement, however, is one according to which a stacking device for the web-loop arrangements is arranged in the receiving device. It is thus possible for a plurality of web-loop arrangements located one above the other to be formed into a stack. According to a further embodiment, the stacking device contains a rear wall, which serves as a stop for the web-loop arrangement which is to be received, a base, which can be lowered to the thickness of the web-loop arrangement, and a cover, which can be adjusted in relation to the base and serves at least as a top guide for a web-loop arrangement which is to be transferred. According to still another embodiment, the cover serves as a top boundary of the stack and can additionally be displaced parallel with the base. The stacking of the web-loop arrangements is facilitated if, according to an additional embodiment, the receiving device contains a retractable accommodating base which is preferably formed from two base halves which can be retracted in opposite directions.

The stacking device of the system can advantageously be lowered into a packing station in which the web-loop stack can be ejected out of the stacking device, by means of an ejecting ram, into an associated packaging container. In another embodiment, the packaging container contains a base with three side walls integrally formed on it and, on the fourth side, a side-wall part which can be swung downward, with the result that the web-loop stack can be pushed onto the base of the packaging container on this fourth side. The side-wall part can be swung upward in order to cover the fourth side of the filled packaging container. A cover is articulated on the side wall which is located opposite the fourth side, this cover having a wall part which at least largely covers the fourth side, this also ensuring that the pack is closed off satisfactorily on the fourth side.

BRIEF DESCRIPTION OF THE DRAWINGS

Exemplary embodiments of the invention are described in more detail hereinbelow with reference to schematic drawings, in which.

DESCRIPTION OF THE INVENTION

Figure 1:
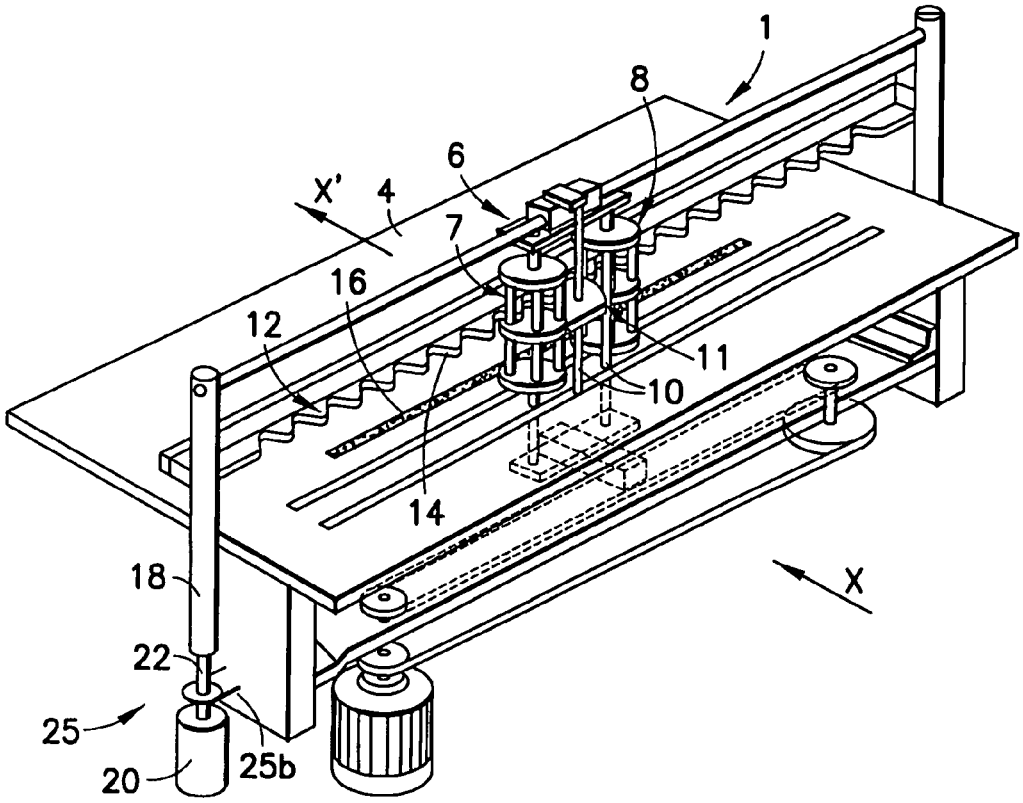
FIG. 1 shows a diagrammatic illustration of a positioning device for forming an arrangement from a web positioned in zigzag form.
Figure 2:
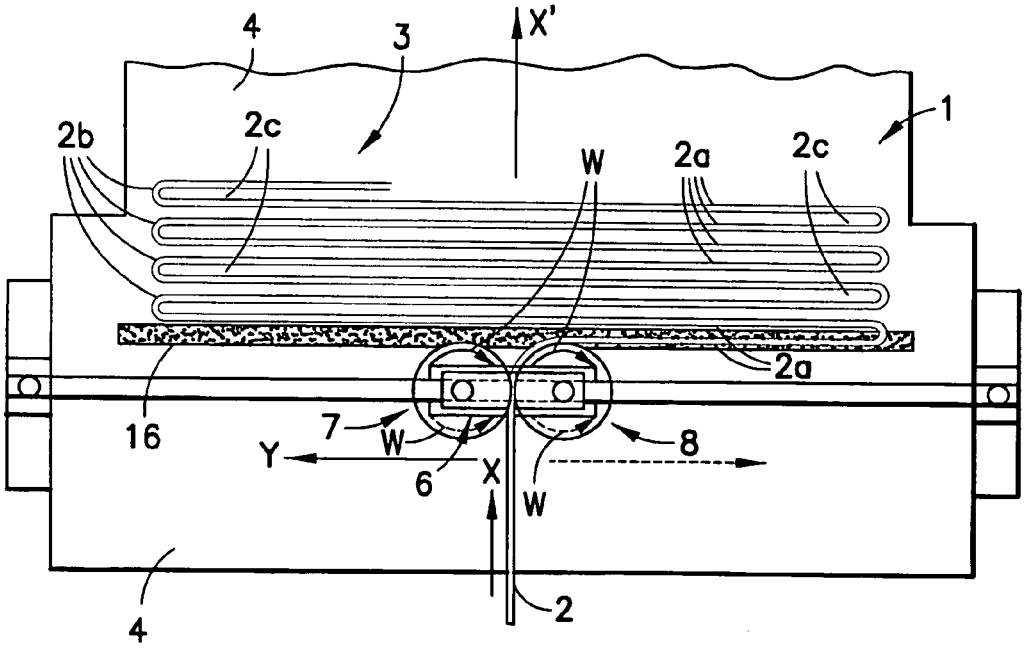
FIG. 2 shows the positioning device from FIG. 1 in a view from above and in detail form.

FIGS. 1 and 2 show a positioning device 1 which is known from EP 0 778 236 A and EP 0 062 753 B and by means of which a flexible, in particular also an elastically expandable, web 2 can be folded into zigzag-form loops 2*a* located one behind the other in group form, that is to say a web-loop arrangement 3 can be formed.

The folded web 2 or the loops 2*a* thereof then has/have rectilinear portions, which are in parallel abutment with one another, and lateral 180'-turns, that is to say folds 2*b*. For reasons of clarity, FIG. 2 has illustrated the zigzag-form loops 2*a* in a state in which they have been drawn some way apart from one another; in practice, however, they butt closely against one another. The web folded in this way, preferably a textile web, is then processed further in the textile industry; it allows straightforward withdrawal in the direction of any desired processing machines. In addition, webs which are folded in this way can be stored and despatched in a significantly more compact manner than would be possible, for example, using reels. Moreover, it is possible for, as it were, endless webs to be distributed over a plurality of packaging containers, the web running on continuously from packaging container to packaging container by the end of the web of one packaging container forming the start of a new packaging container.

The positioning device 1 is illustrated in a relatively detailed manner in FIG. 1, but only those constituent parts which are pertinent to the present invention will be explained hereinbelow. In respect of the rest of the features not explained here, you are referred in full to EP 0778236A and EP 0062753 B, which have already been mentioned in the introduction.

The device 1 has a bearing panel 4 for the web 2 which is to be folded and/or for the folded zigzag-form web loops 2*a*. A positioning carriage 6 is arranged above the bearing panel 4 such that it can be moved back and forth perpendicularly to the drawing-in direction X of the web, see the arrows Y in FIG. 2. The positioning carriage 6 has two positioning rollers 7 and 8, which are mounted one beside the other such that they can be rotated about two parallel axes. The axes of rotation of the positioning rollers 7, 8 run perpendicularly to the displacement direction Y of the positioning carriage 6 and perpendicularly to the drawing-in direction X of the web. A vertical guide nip for the web 2 which is to be placed in position is formed between the two circumferential surfaces of the positioning rollers 7, 8; the web 2 guided between two guide rods 10 of a guide device 11 runs into this guide nip in the drawing-in direction X. The web 2 here is located in a vertical, that is to say upright, position. The nip between the positioning rollers 7, 8 is dimensioned such that the web 2 is carried along by friction by the circumferential surface in each case of one of the two positioning rollers 7, 8. The positioning rollers 7, 8 are driven in the same direction in each case, the direction of rotation being dependent on the displacement direction of the positioning carriage 6 in each case.

This dependency is illustrated in FIG. 2, according to which, when the positioning carriage 6 is displaced to the left (solid arrow Y), the positioning rollers 7, 8 rotate to the right (solid arrow W). When the positioning carriage is displaced to the right (dashed arrow Y), the positioning rollers 7, 8 rotate to the left (dashed arrow W). The web material 2 is thus carried along, and drawn in, by abutment in each case by the rear positioning roller 7 or 8, as seen in the displacement direction, and thus transported further. The abovedescribed drive results in the web being positioned in regular zigzag-form web loops 2*a*. The change in the direction of rotation W of the positioning rollers 7, 8 takes place in each case at the point of reversal of the displacement movement of the positioning carriage 6. By virtue of the web 2 being laid in position, the positioned web loops are advanced in the manner of a group, that is to say are moved on in a removal direction X' corresponding to the drawing-in direction X.

In order for the web 2, which runs in relatively quickly, to be braked in the laying region downstream of the positioning carriage 6, and in order thus to aid the loop formation, braking means which subject the longitudinal edges of the web 2 to a contact-pressure force in the folding region are provided. A significant constituent part of these braking means is formed by a pressure-exerting bar 12 which is arranged in the region of the positioning rollers 7, 8, on the web-outlet side thereof, and of which the length is at least equal to the range of movement of the positioning carriage 6. The pressure-exerting bar 12 here runs parallel to the displacement direction of the positioning carriage 6 and preferably above the latter, with the result that the pressure-exerting bar acts on the top longitudinal edge of the web 2 by forcing the web 2 some way downward from above by way of its bottom pressure-exerting surface 14, which is directed toward the web. In the exemplary embodiment illustrated, the pressure-exerting bar 12 interacts with a bottom braking bar 16 arranged in the region of the bearing panel 4, the web or its loop 2*a* which was last placed in position being, for all practical purposes, clamped in between the braking bar 16 and the pressure-exerting bar 12.

As can be gathered from FIG. 2, the folds 2*b* are usually located in a row one behind the other. In order to counteract the expansion force of the web-loop arrangement which is brought about by the folds, it is advantageous if, rather than all the folds 2*b* being aligned in a row, every second fold 2*c* is set back in relation to the first fold 2*b*, as is indicated by dashed lines in FIG. 2. Multiple offsetting of the folds is thus also possible.

The pressure-exerting bar 12 is fastened, at both ends, on vertical supports 18 which can be displaced up and down by means of piston/cylinder subassemblies 20 and spindles 22. The piston/cylinder subassemblies 20 serve for periodically raising up the pressure-exerting bar 12 during transfer of a web-loop arrangement 3 from the positioning device 1 into a receiving device 24, as can be gathered from FIG. 3. An adjusting device 25 serves for adjusting the magnitude of the contact-pressure force to which the web loops are subjected by the pressure-exerting bar 12. The adjusting device 25 has a stepping motor 25*a* which interacts via a gear mechanism 25*b*, for example a chain gear or toothed belt mechanism, with the spindle 22, which is connected to the supports 18 via a thread, with the result that it is possible to change the spacing of the supports 18 in relation to the piston/cylinder subassemblies 20 and thus the degree to which the pressure-exerting bar 12 presses on the web loop.

Figure 3:
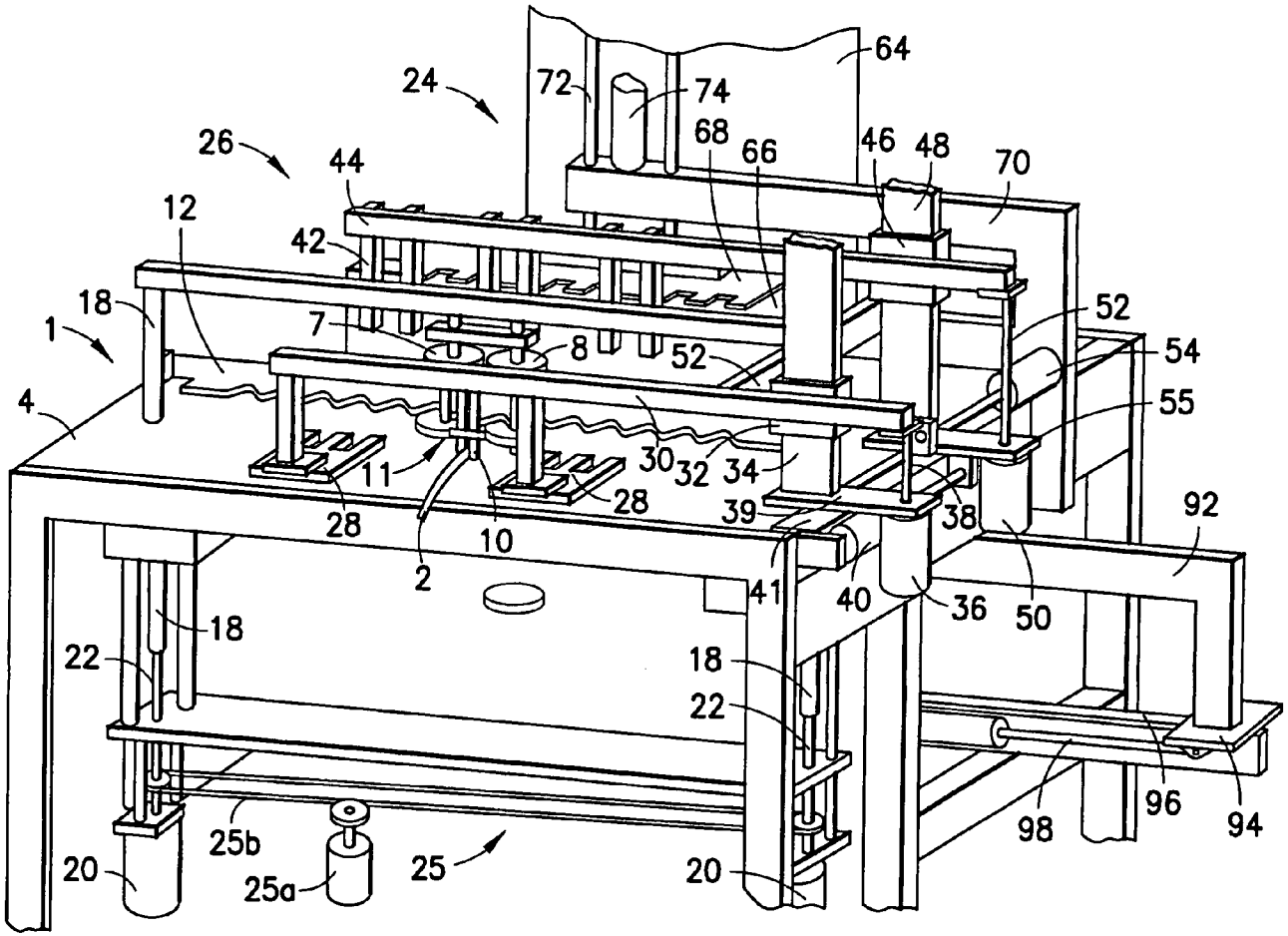
FIG. 3 shows a diagrammatic illustration of a system for packaging a web positioned in zigzag-form loops.
Figure 4:
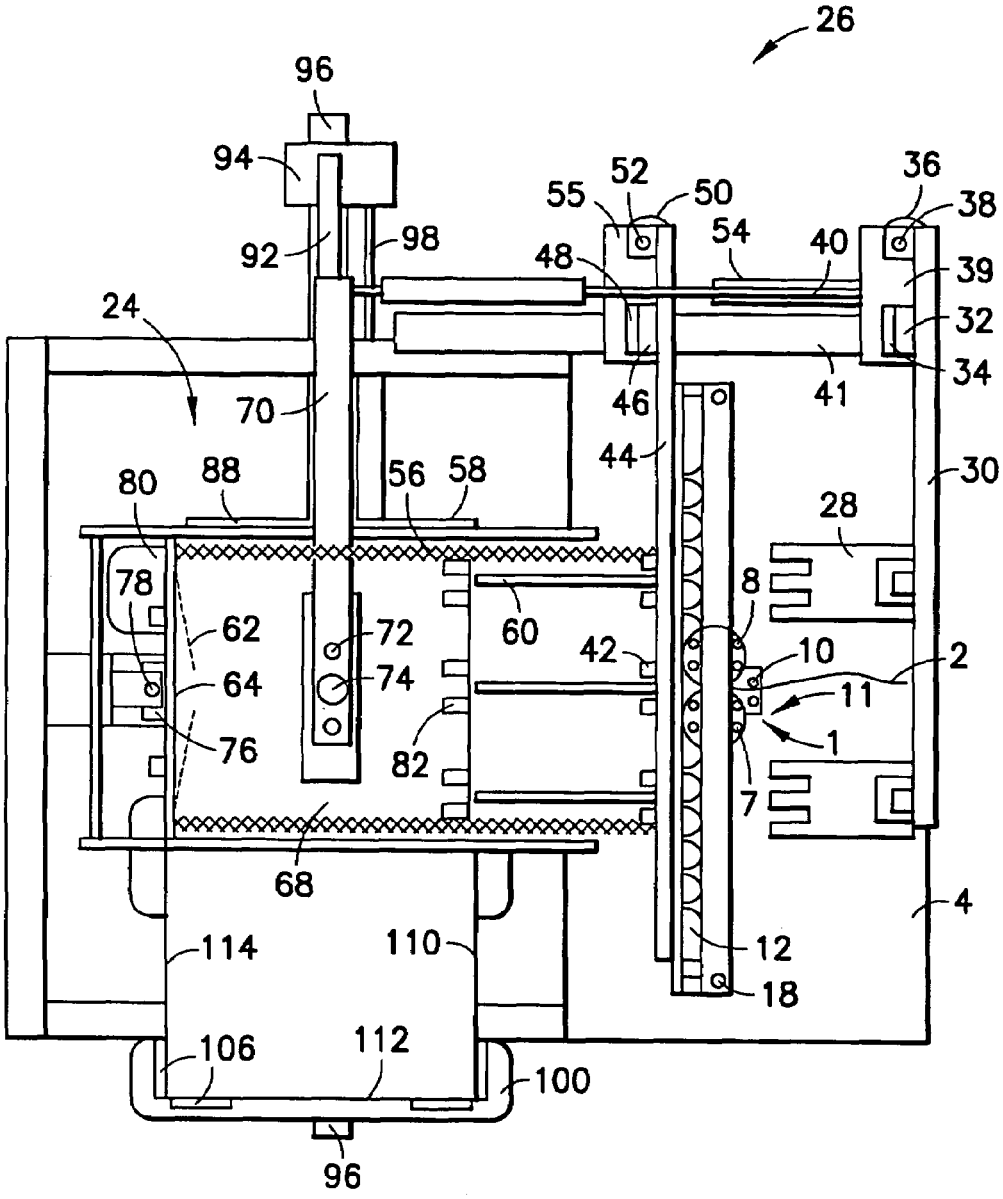
FIG. 4 shows the system from FIG. 3 in a view from above.
Figure 5:
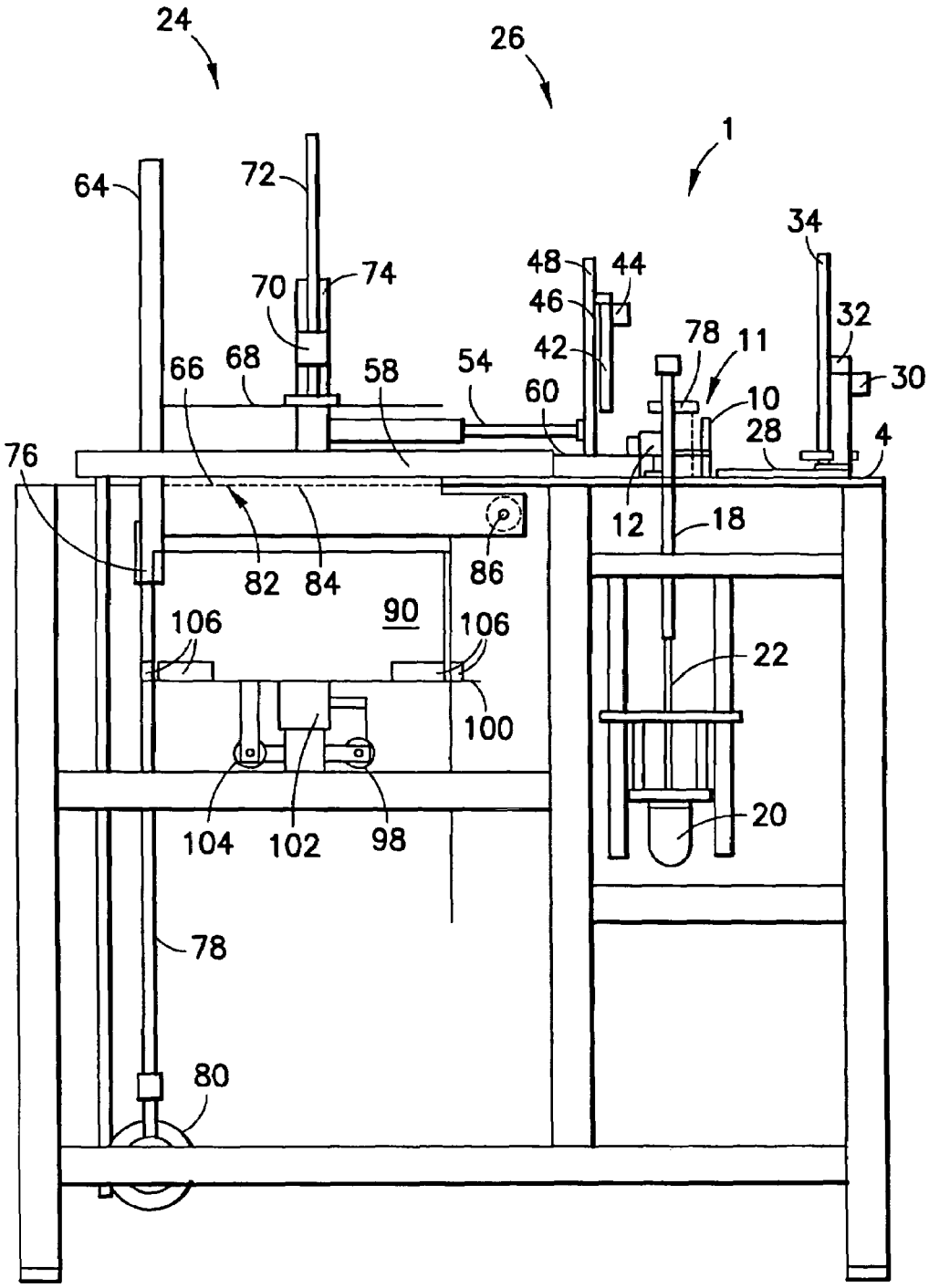
FIG. 5 shows the system from FIG. 3 in a side view from the left.
Figure 6:
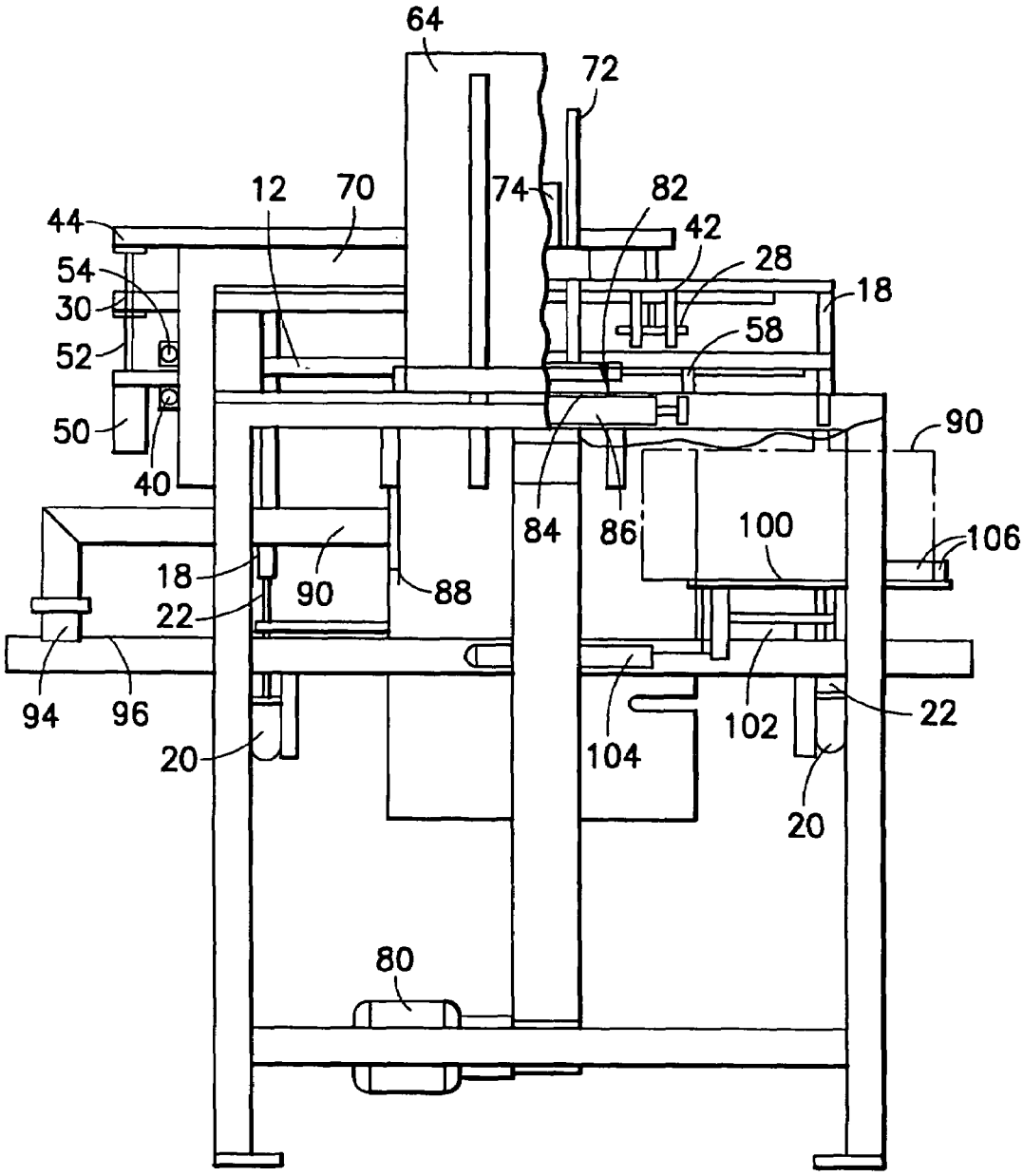
FIG. 6 shows the system from FIG. 3 in a view from the rear.

FIGS. 3 to 6 deal with a system for packaging web-loop arrangements which are produced in the positioning device 1 and are transferred to the receiving device 24 for packaging purposes. The transfer device 26 has finger-like pusher members 28 on the infeed side of the web 2 in the positioning device 1, it being possible for these pusher members to be lowered from a raised rest position into an operating position, which is illustrated in FIG. 3 and in which they are located parallel to the bearing panel of the web-loop arrangement. The finger-like pusher members 28 are fastened on an extension arm 30 which can be displaced on a vertical guide 34, by means of a slide 32, out of the operating position illustrated into a vertically raised rest position, in which it does not obstruct the operation of feeding the web 2 in the positioning device 1. For displacement in the vertical direction, use is made, for example, of a piston/cylinder subassembly 36, of which the piston rod 38 is connected to the extension arm 30. A piston/cylinder subassembly 40 serves for displacing the pusher members 28 beneath the pressure-exerting bar 12, for which purpose a slide 39, which can be displaced along a rail 41, is arranged on the vertical guide 34. The web-loop arrangement 3 is thus advanced in the direction of the receiving device 24. In the advanced position, the transfer device 26 has vertically oriented carry-along fingers 42 which can be lowered from the rest position, which is illustrated in FIG. 3, toward the bearing panel 4 and, there, can be moved in between the pusher members 28 in order to receive the web-loop arrangement and displace it into the receiving device 24 transversely to the loop arrangement. The carry-along fingers 42 are fastened, in a manner analogous to the pusher members 28, on an extension arm 44 which can be displaced on a vertical guide 48 by means of a slide 46. A piston/cylinder subassembly 50 is connected to the extension arm 44 by means of a piston rod 52 and serves for displacing the carry-along fingers 42 vertically out of the rest position into the operating position. A piston/cylinder subassembly 54 serves for displacing the vertical guide 48, which has a slide 55, along the horizontal rail 41.

In order to improve the transfer of the web-loop arrangement 3, braking strips 56 are arranged along the displacement path of the folds of the web-loop arrangement, on the bearing panel 4, following the path into the receiving device, and in the receiving device 24. Such braking strips may be formed, for example, by virtue of the bearing panel 4 being roughened or of rough strips being attached by adhesive bonding. Guide bars 58 are used on both sides of the web-loop arrangement, and guide bars 60 are used above the web-loop arrangement, for the ordered transfer of the web-loop arrangement into the receiving device 24. Resiliently yielding stop members 62 are arranged in the receiving device 24, in the region between the folds of the web-loop arrangement, in order for web parts which curve forward in the receiving direction to be oriented parallel to the loop arrangement.

The receiving device 24 is designed as a stacking device for the web-loop arrangements. The stacking device has a rear wall 64, which serves as a stop for the web-loop arrangement which is to be received, also a base 66, which can be lowered in a stepwise manner by the thickness of the web-loop arrangement, and a cover 68, which can be adjusted in relation to the base and the thickness of the web-loop arrangement, and thus the width of the web, and serves at least as a top guide for a web-loop arrangement which is to be transferred.

The cover 68 is fastened on an extension arm 70 such that it can be adjusted in height via guide rods 72. A drive 74, for example a piston/cylinder subassembly 74, serves, on the one hand, for advancing the cover 68 as a top guide of the web-loop arrangement during transfer from the positioning device and, on the other hand, for lowering the cover 68 synchronously with the base 66 when the stacking device is lowered. The base 66 is fastened on the rear wall 64 and can be lowered therewith. For this purpose, the rear wall 64 is connected, via a threaded part 76, to a spindle 78 which is driven by a geared motor 80. The base 66 can thus be lowered in each case by the thickness of a web-loop arrangement, with the result that a plurality of web-loop arrangements can be stacked one above the other. For this purpose, the receiving device contains an accommodating base 82 which can be extended the bearing panel 4 above the stacking device and is formed from two base parts 84 which can be retracted in opposite directions and can each be moved laterally out of the stacking region by means of a drive 86, for example a piston/cylinder subassembly, in order to set down a web-loop arrangement on the stack.

The stacking device 24 can be lowered into a packing station in which the stack of web-loop arrangements can be ejected out of the stacking device, by means of an ejecting ram 88, into a laterally assigned packaging container 90. The ejecting ram 88 is fastened on an arm 92 which can be displaced along a rail 96 by means of a slide 94. A piston/cylinder subassembly 98 serves for displacing the ram.

The packaging container 90 is arranged on a carrier 100 which can be advanced along the rail 96 toward the stacking device by means of a slide 102. A piston/cylinder subassembly 104 is used for driving purposes. The carrier 100 contains stops 106 for orienting the packaging container 90 in relation to the stacking device 24.

Figure 7:
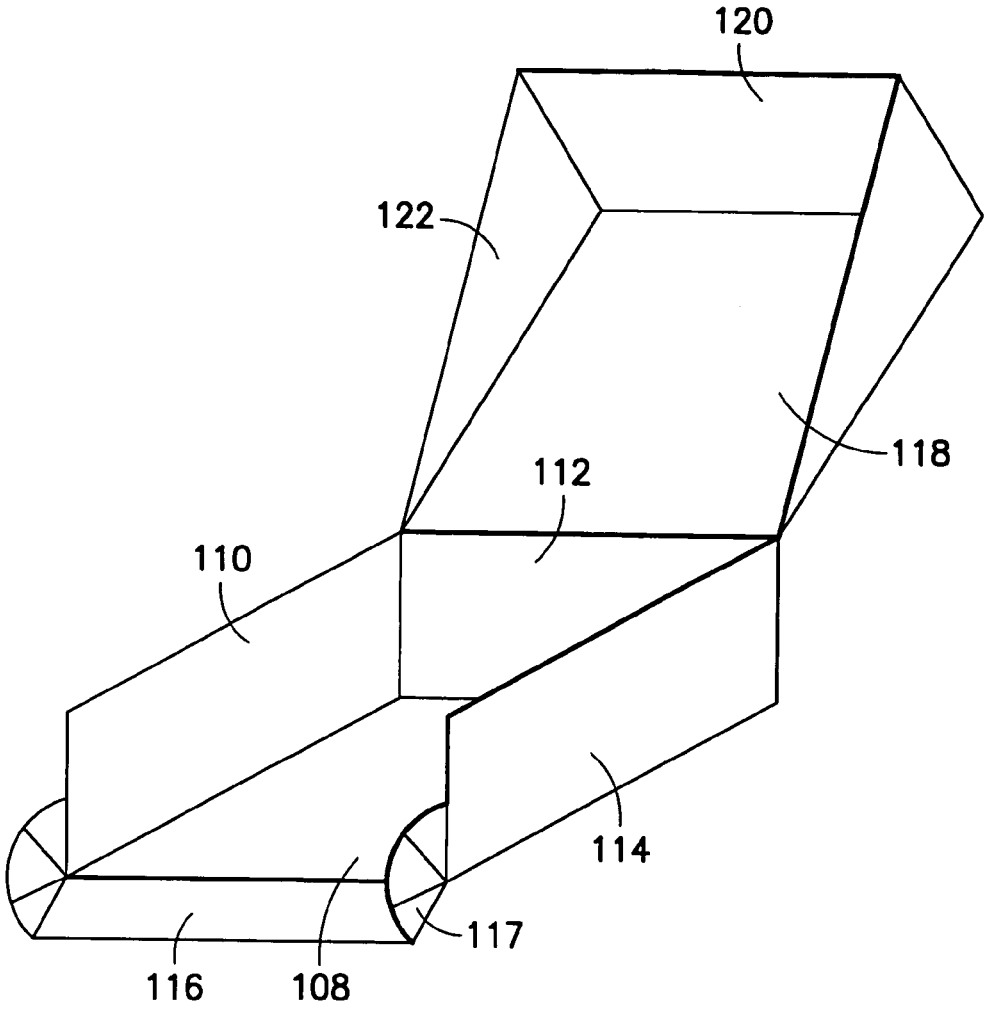
FIG. 7 shows a packaging container for the web-loop arrangements.
Figure 8:
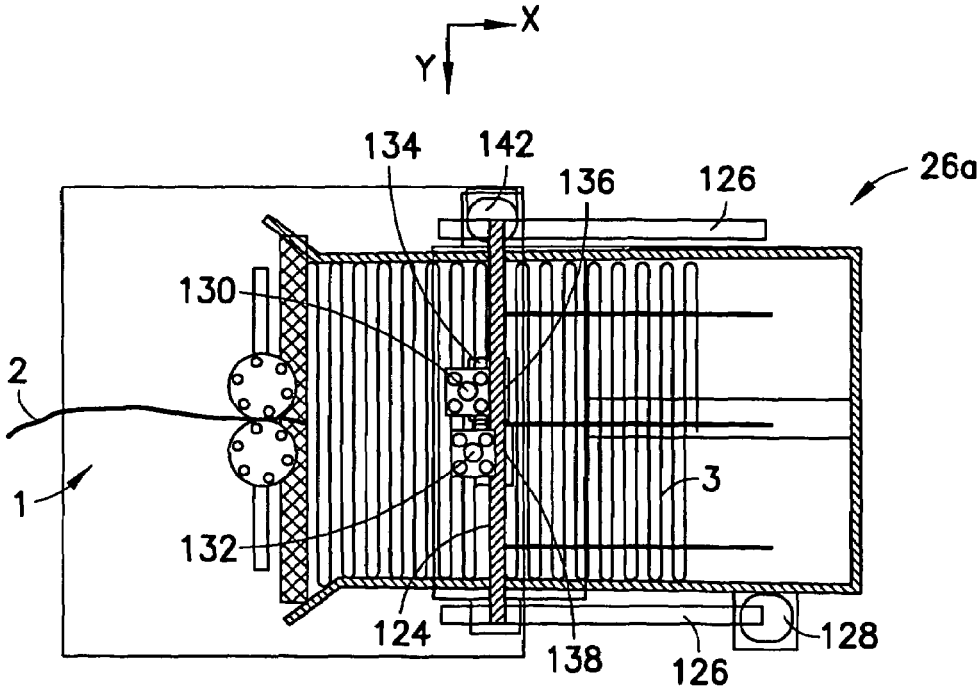
FIG. 8 shows a plan view of a further simplified system for packaging purposes.
Figure 9:
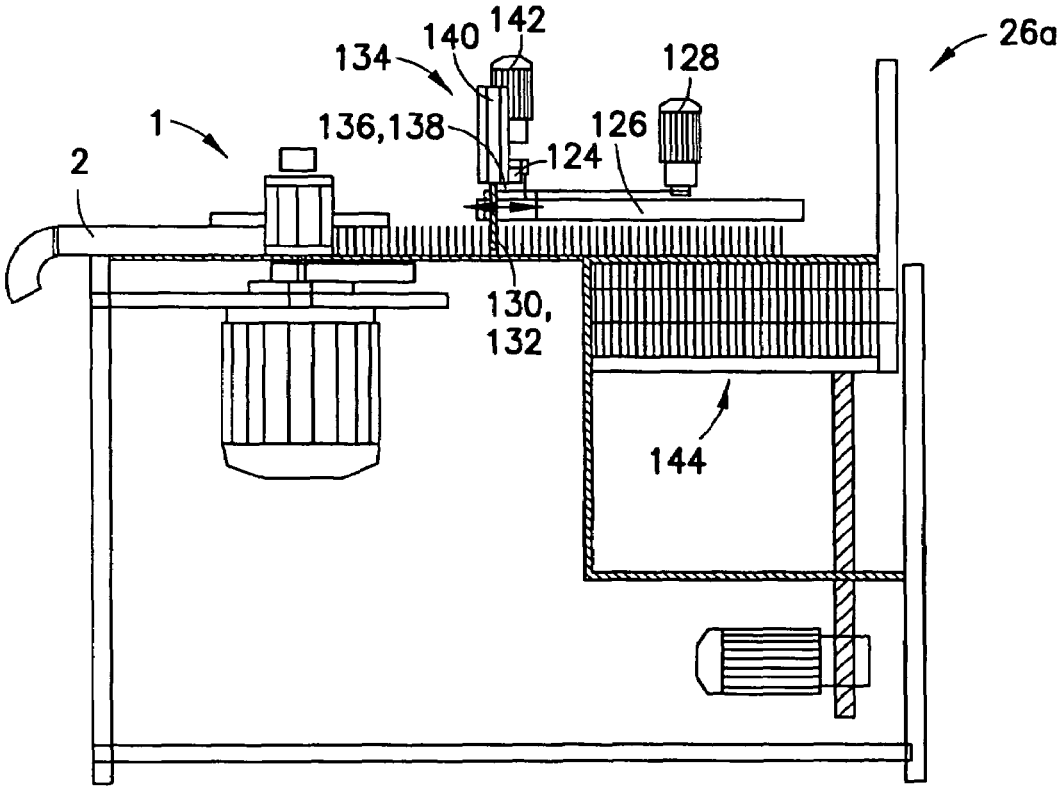
FIG. 9 shows the system from FIG. 8 along section line IX—IX from FIG. 8.

FIG. 7 shows a preferred packaging container 90 for accommodating a stack of web-loop arrangements. The packaging container 90, which preferably consists of cardboard, contains a base 108 with three side walls 110, 112, 114 integrally formed on it. Arranged on the fourth side, which serves for the introduction of the group of web loops, is a side-wall part 116 which can be swung downward and has lateral folding elements 117. A cover 118 is articulated on the opposite side wall 112, this cover having a border part 120 which at least largely covers the fourth side 116 and is supported by side parts 122 of the cover 118. This design allows, on the one hand, satisfactory transfer of the group of web loops into the packaging container 90 and, on the other hand, secure closure of the packaging container once the group of web loops has been accommodated.

The abovedescribed drive elements such as stepping motors and piston/cylinder subassemblies are indeed specifically preferred drive elements, but other configurations of the drives are also possible.

A memory-programmable control device with microprocessors (this device not being illustrated specifically) serves for the coordinated control of the movement sequences and adjustments of the various components of the system in order to achieve at least partially automatic, but preferably fully automatic, operating sequences. In particular, it is possible, using the control device, to adjust the length of the web loops 2*a* which is desired during the folding operation, as is indicated in FIG. 2. It is thus possible to produce web loops of different lengths from one web loop to the next, with the result that the folds 2*b*, 2*c* of the successive web loops 2*a* are offset laterally, closer packing of the web loops thus being possible. The control device can also be used to adjust the length of the web which is to be packaged in a pack and to distribute this length uniformly over all the web-loop arrangements of the pack. This achieves not just optimum packaging, but also a web-loop density which is uniform throughout the pack, this resulting in the quality of the packaged web being uniform throughout the pack. The improvements which are possible are achieved with a simultaneous increase in performance and reduced manpower.

FIGS. 8 to 11 show schematic illustrations of a further simplified embodiment of a system for packaging a flexible web 2 which is positioned in zigzag-form loops. The same designations are used for features which are the same as those in the system from FIGS. 1 to 7. The schematically illustrated positioning device 1 corresponds to that from FIGS. 1 to 6.

The transfer device 26*a*, which is arranged downstream of the positioning device 1, has a displacement bar 124 which engages over the positioning region and is arranged on linear guides 126 on both sides of the positioning region such that it can be displaced in the X-direction by means of a drive 128, for example of a stepping motor connected to a linear gear mechanism. The displacement bar bears two blades 130, 132 which can each be moved in and out in relation to the web-loop arrangement 3 by means of a drive 134 and can be displaced along the displacement bar 124 by means of slides 136, 138. The drives 134 used for the blades are, for example, piston/cylinder subassemblies 140, of which the piston rods are designed as blades 130, 132. The slides 136, 138 can be displaced counter to one another in the Y-direction, that is to say transversely to the displacement direction of the displacement bar 124, out of a central position above the positioning region or the web-loop arrangement by means of a further drive 142, for example of a circulating pulling mechanism.

This system according to FIGS. 8 to 11 does not require any pusher members for pushing a web-loop arrangement through beneath the pressure-exerting bar; rather, it functions as follows.

Figure 10:
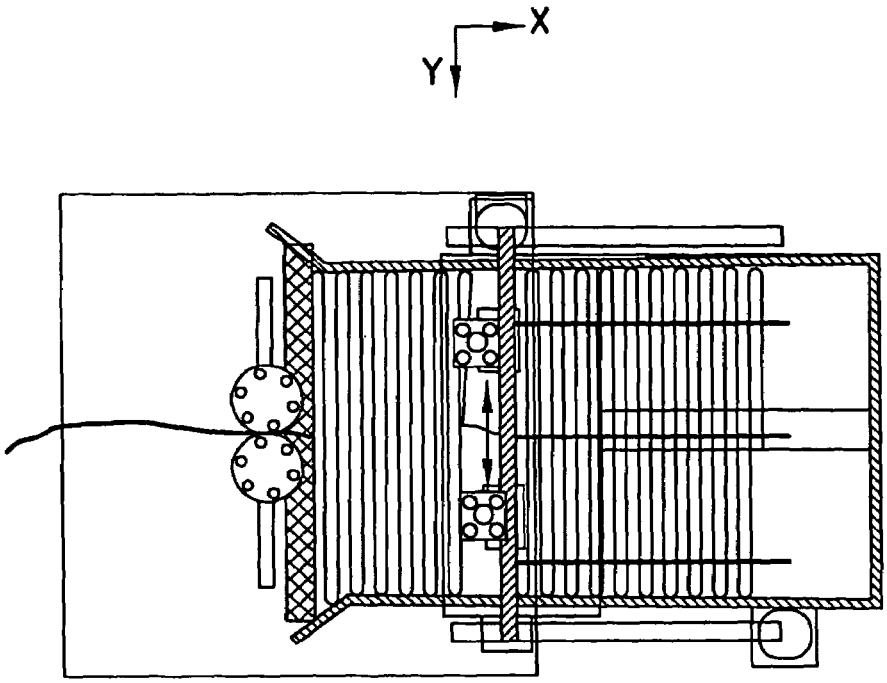
FIGS. 10 and 11 show the system from FIG. 8 during different transfer stages.
Figure 11:
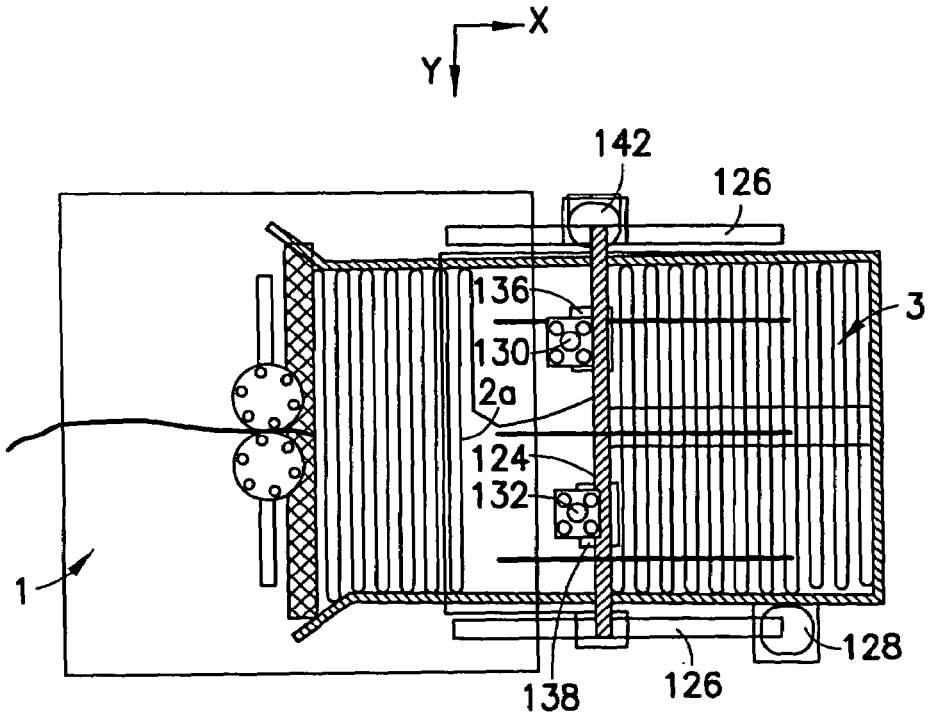

In the first instance, a blade 130 is moved into the web-loop arrangement 3, passing out of the positioning device 1, at a predetermined location between a web loop 2*a*, and the displacement bar 124 is advanced in the X-direction until the web loop is opened. The first blade 130 is then raised again and the two blades 130, 132 are moved centrally into the opened web loop 2*a* and moved apart from one another in the Y-direction until they are spaced apart from the border of the web-loop arrangement by a distance corresponding approximately to a quarter of the width of the web-loop arrangement, as is shown in FIG. 10, this bringing the operation of separating the web loop to completion. With the blades 130, 132 lowered, the displacement bar 124 is displaced in the X-direction until the web-loop arrangement which has been separated off has reached the stacking device 144 of the transfer device. The blades 130, 132 are then raised and the displacement bar is moved back into the starting position for the transfer of a further web-loop arrangement.

The operations of separating off and transferring the web-loop arrangement can take place with interrupted, but preferably continuous loop positioning on the part of the positioning device.

The invention claimed is:

1. A system for packaging a flexible web which is positioned in zigzag-form loops, comprising:

a horizontal bearing panel;

a positioning device arranged above the horizontal bearing panel and including a positioning carriage which is movable back and forth and has two positioning rollers which are arranged beside one another and with axes parallel to one another, the rollers being driven in rotation in a common direction and between which an individual web can be drawn in from an infeed side and can be folded by the positioning carriage being moved back and forth perpendicularly to the drawing-in direction of the web and can be advanced beneath a pressure-exerting bar in a removal direction corresponding to the drawing-in direction, the positioning device being assigned a transfer device for forming a web-loop arrangement of predeterminable magnitude and for transferring the web-loop arrangement directly or indirectly into a packaging container; and a memory-programmable control device for components of the system.

2. The system as claimed in claim 1, wherein the control device is operative to control the system fully automatically.

3. The system as claimed in claim 1, wherein the control device is operative to adjust a length of the web loops to a different magnitude from web loop to web loop.

4. The system as claimed in claim 1, wherein the control device is operative to adjust a length of the web for each web-loop arrangement so that with multi-arrangement packs the overall length of the web of the pack is distributed uniformly over all the arrangements.

5. The system as claimed in claim 1, wherein the transfer device has blades which are located downstream of the positioning device, are provided on a displacement bar and are arranged so as to be movable in between two web loops from above and movable apart laterally in order to separate two web loops and to transfer the web-loop arrangement located in front of the blades.

6. The system as claimed in claim 1, wherein said pressure-exerting bar extends over an entire loop length, is advanceable perpendicularly to said bearing panel for the web-loop arrangement, and is pressable against edges of the web loops with adjustable magnitude.

7. The system as claimed in claim 6, wherein the positioning device further includes a controllable drive operatively arranged to raise and lower the pressure-exerting bar.

8. The system as claimed in claim 6, and further comprising guide bars arranged above the bearing panel so as to guide the web-loop arrangement and be oriented transversely to the loop arrangement.

9. The system as claimed in claim 6, wherein the transfer device has pusher members on an infeed side of the web in the positioning device, the pusher members being movable out of a rest position, in which the pusher members do not impede running of the web, into an operating position, in which the pusher members are movable beneath the pressure-exerting bar, parallel to the bearing panel of the web-loop arrangement, up to a point on an opposite side of the pressure-exerting bar where carry-along elements are movable in between or behind the web-loop arrangement from a rest position in order for the web-loop arrangement to be displaced into a receiving device, transversely to the loop arrangement, by the carry-along elements.

10. The system as claimed in claim 9, wherein the pusher members have fingers.

11. The system as claimed in claim 9, wherein the pusher members are arranged so as to be lowerable vertically into the operating position from a raised rest position above the bearing panel.

12. The system as claimed in claim 9, wherein the carry-along elements have fingers and are movable in between the pusher members in a vertically downward direction from a top rest position.

13. The system as claimed in claim 9, wherein the bearing panel has braking strips arranged along the displacement path of the folds of the web loops, from the positioning device into the receiving device.

14. The system as claimed in claim 9, and further comprising at least one resiliently yielding stop member arranged in the receiving device in a region between the folds, in order for web parts which curve forward in a receiving direction to be oriented parallel to the loop arrangement.

15. The system as claimed in claim 9, wherein the receiving device is a stacking device for the web-loop arrangements.

16. The system as claimed in claim 15, and further comprising an ejecting ram, the stacking device being lowerable into a packing station in which the web-loop stack is ejectable out of the stacking device by means of the ejecting ram into an associated packaging container.

17. The system as claimed in claim 15, wherein the stacking device has a rear wall that serves as a stop for the web-loop arrangements which are to be received, a base which can be lowered by a thickness of the web-loop arrangements, and a cover which can be adjusted in relation to the base and serves at least as a top guide for a web-loop arrangement which is to be transferred.

18. The system as claimed in claim 17, wherein the cover is displacable parallel to the base as a top boundary of the stack.

19. The system as claimed in claim 9, and further comprising an accommodating base in the receiving device, the accommodating base being retractable in a base plane.

20. The system as claimed in claim 19, wherein the accommodating base includes two base halves that are retractable laterally in opposite directions.

* * * * *